United States Patent [19]

Pook et al.

[11] Patent Number: 4,461,438

[45] Date of Patent: Jul. 24, 1984

[54] APPARATUS FOR CONTROLLING AND STORING A KITE

[75] Inventors: Peter D. Pook, Bloomington; Charles W. Girsch, St. Paul, both of Minn.

[73] Assignee: Team Winsor, St. Paul, Minn.

[21] Appl. No.: 353,055

[22] Filed: Mar. 1, 1982

[51] Int. Cl.[3] ..... B64C 31/06

[52] U.S. Cl. ..... 244/153 R; 244/155 R

[58] Field of Search ..... 244/153 R, 153 A, 154, 244/155 R, 155 A; 242/96; 43/20, 23; 403/100, 102, 220, 119; 2/262; 16/DIG. 13

[56] References Cited

U.S. PATENT DOCUMENTS

| | | | |
|---|---|---|---|
| 176,721 | 4/1876 | Whitcomb | 244/153 R |
| D. 231,245 | 4/1974 | Christoffel, Jr. | 244/153 R |
| 274,340 | 3/1883 | Kelly | 244/153 |
| 297,215 | 4/1884 | Wood | 244/153 R |
| 1,328,143 | 1/1920 | Fergusson | 244/153 |
| 1,456,260 | 5/1923 | Trombley | 244/153 |
| 2,769,605 | 11/1956 | Sparkman | 244/153 R |
| 3,003,722 | 10/1961 | Pohl | 244/153 R |
| 3,076,626 | 2/1963 | Andrews | 244/154 |
| 3,131,895 | 5/1964 | Moore | 244/153 R |
| 3,179,351 | 4/1965 | Ehlert | 242/96 |
| 3,276,730 | 10/1966 | Cleveland | 244/153 |
| 3,335,985 | 8/1967 | Neal | 244/153 R |
| 3,393,535 | 7/1968 | Morin | 403/220 |
| 3,438,595 | 4/1969 | Brown et al. | 242/96 |
| 3,494,578 | 2/1970 | Cureton | 244/153 |
| 3,534,932 | 10/1970 | Christoffel et al. | 244/153 R |
| 3,570,790 | 3/1971 | Christoffel et al. | 244/153 R |
| 3,570,792 | 3/1971 | Christoffel et al. | 244/153 R |
| 3,627,240 | 12/1971 | Christoffel et al. | 244/153 R |
| 3,687,402 | 7/1972 | Christoffel et al. | 244/153 R |
| 3,746,286 | 7/1973 | Cristoffel | 244/155 |
| 3,807,672 | 4/1974 | Williams | 244/155 A |
| 3,952,975 | 4/1976 | Laske | 244/153 R |
| 3,980,260 | 9/1976 | Laske | 244/153 R |
| 4,018,407 | 4/1977 | Aber | 244/153 R |
| 4,027,419 | 6/1977 | Popeil | 43/20 |
| 4,111,387 | 9/1978 | Leary | 244/155 |
| 4,129,273 | 12/1978 | Hill | 244/155 A |
| 4,150,804 | 4/1979 | Jackson | 244/153 R |
| 4,159,087 | 6/1979 | Moomaw | 244/154 |

FOREIGN PATENT DOCUMENTS

| | | | |
|---|---|---|---|
| 81304335.3 | 9/1981 | European Pat. Off. | 244/153 R |
| 539154 | 6/1922 | France | 244/153 R |
| 569841 | 6/1945 | United Kingdom | 244/153 R |
| 997791 | 7/1965 | United Kingdom | 244/153 R |

*Primary Examiner*—Trygve M. Blix
*Assistant Examiner*—Rodney Corl
*Attorney, Agent, or Firm*—Kinney & Lange

[57] ABSTRACT

An apparatus is used for both controlling a kite and then compactly storing the kite when the kite is not in use. The apparatus includes a housing having a storage compartment and a kite which can be collpased so as to be compactly stored in the compartment. A reel attached to the housing is adapted for storing and dispensing the kite line. In use, the housing is held in one hand and the reel is operated by a handle such that the kite line can be dispensed to control the kite and then can be reeled in, retrieving the kite.

17 Claims, 17 Drawing Figures

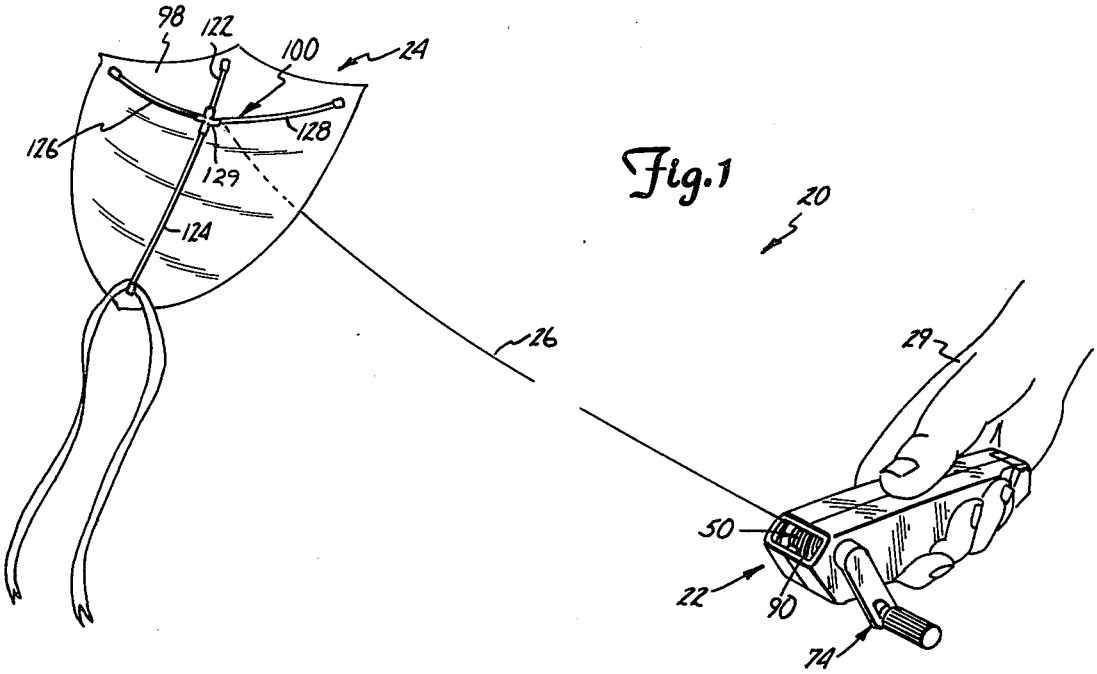
Fig. 1
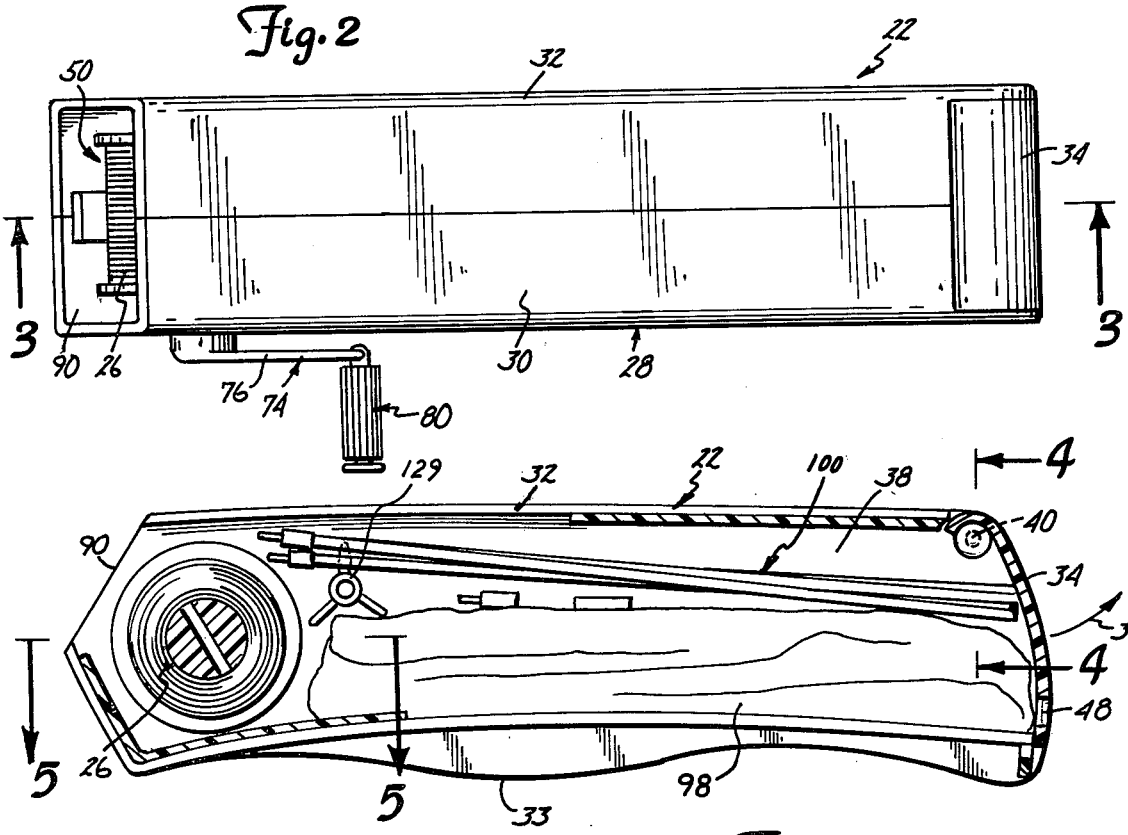
Fig. 2
Fig. 3

Fig. 4
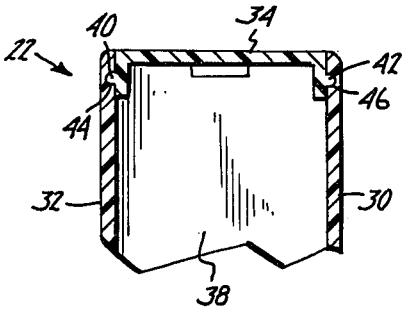
Fig. 6
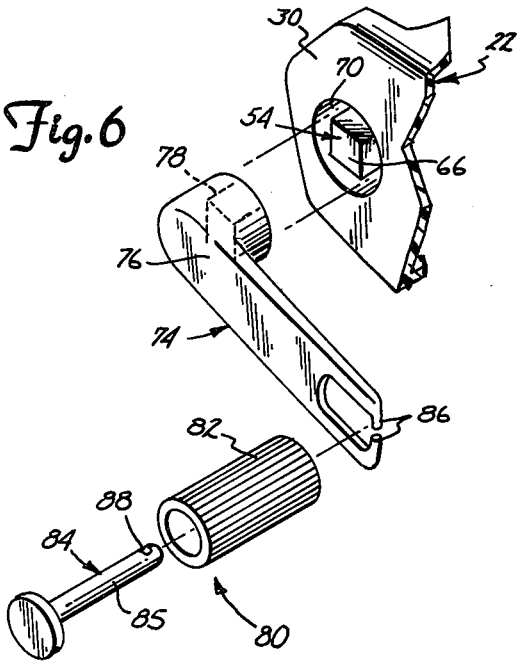
Fig. 9
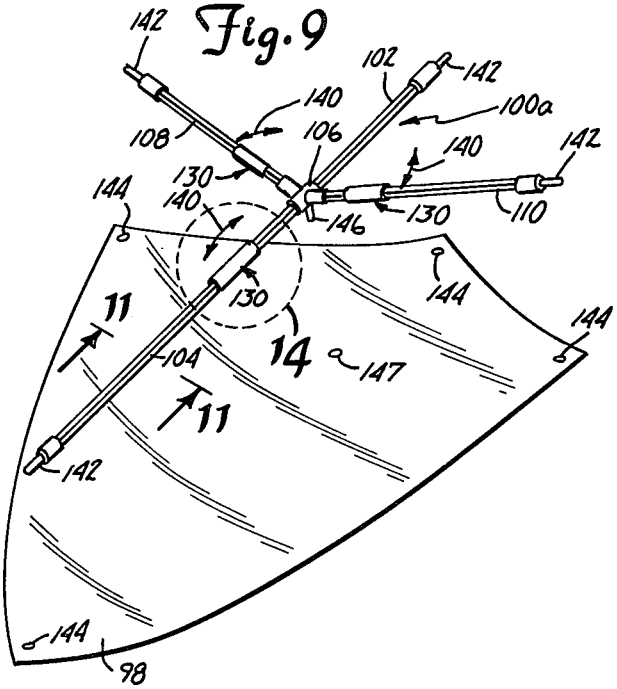
Fig. 15
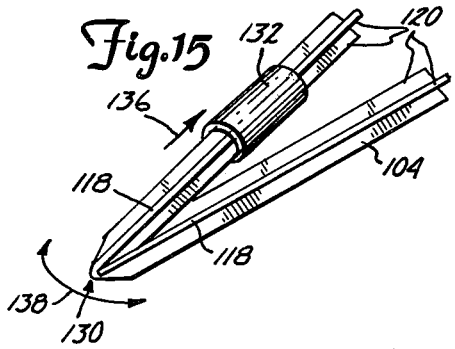
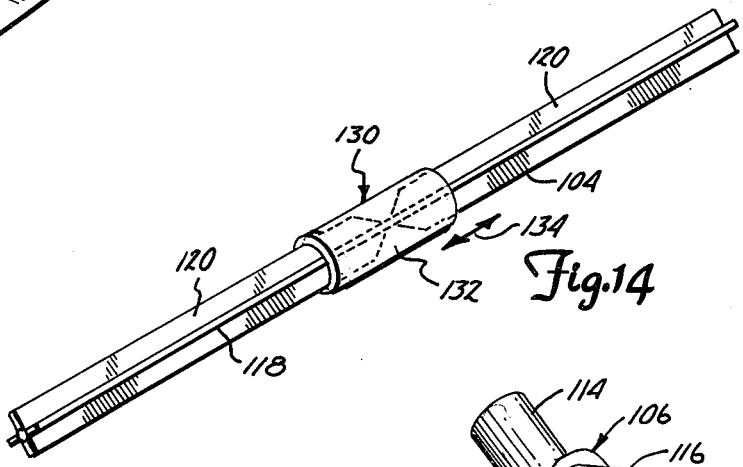
Fig. 14
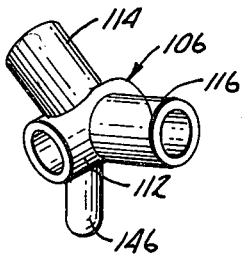
Fig. 10
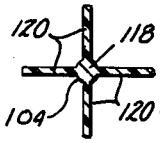
Fig. 11

Fig. 7
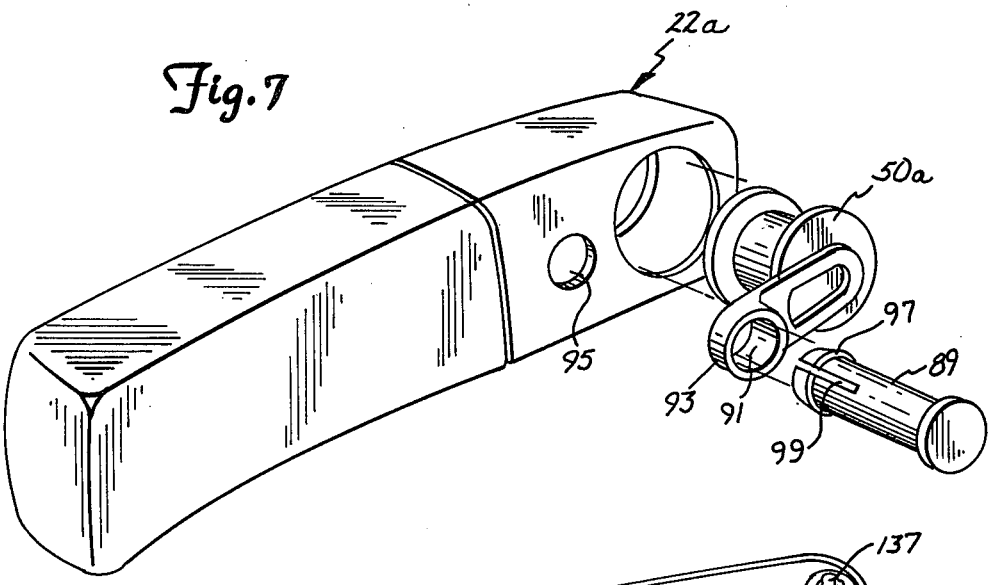
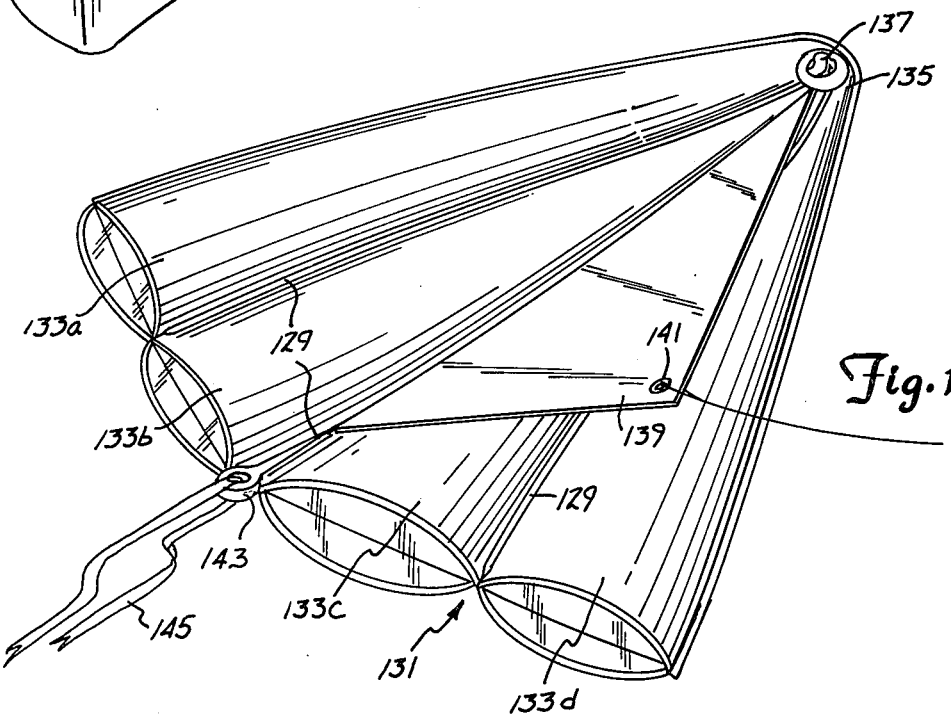
Fig. 12
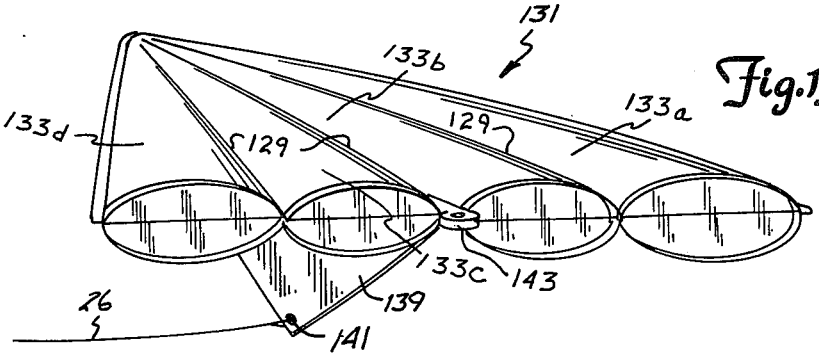
Fig. 13

APPARATUS FOR CONTROLLING AND STORING A KITE

BACKGROUND OF THE INVENTION

1. Field of the Invention

The present invention relates to an apparatus for controlling the flying of a kite and for compactly storing the kite when the kite is not in use.

2. Description of the Prior Art

Kite flying is a very popular pasttime. Typically, kites are initially in disassembled form, having been assembled for flying and then disassembled for storing. A line, stored on a spool typically in the form of a ball, is used to control the flying of the kite.

Several disadvantages are inherent in kites which limit their use and enjoyment. First, the various parts of the kite are often times either lost or damaged when the kite is stored in a disassembled form. Second, a storage place must be found to store the kite safely until it is used again, presenting an inconvenience to the kite user. Third, in flying the kite, the kite line is taken off the ball of line while holding the ball in one hand. Frequently, in unwinding the kite line, the ball of line will accidentally fall to the ground, allowing more line than desired to come off the spool. Fourth, when retrieving the kite, the line must be rewound around the ball to avoid tangling the line. However, the rewinding of the kite line around the ball does not always prevent tangling of the line and commonly results in the kite line being wound in a loose and messy manner. Fifth, when the rewound ball of line is stored for further use with the kite, the line, having been wound in a loose manner, frequently slides off the spool or the spool rolls around, unwinding line. Sixth, the time intervals between flying the kite may be rather long, and the ball of line and the kite may become separated from each other with either ball of line or kite disappearing or the ball of line being used for other purposes and having to be purchased again.

Several kite flying mechanisms have been developed that store a kite line on a reel and are used to control the flying of the kite.

The Williams U.S. Pat. No. 3,807,672 shows a mechanism that includes a reel for controlling the flying of a kite. The mechanism includes a handle and three reels with three kite lines attached to a frame. The three lines come off of the reels and are separated by a spider mechanism. A hand crank is included to operate the reels. However, after the kite has been flown, the problem of storing the kite still remains.

In the Leary U.S. Pat. No. 4,111,387, a reel containing kite line is mounted between two extending legs that are part of a handle. The Leary patent also does not recognize the problem of storing the kite after use.

The Hill U.S. Pat. No. 4,129,273 shows a framework containing two reels with kite line and the reels being operated by a handle. The Hill patent also does not recognize the problems of kite storage.

SUMMARY OF THE INVENTION

The present invention includes an apparatus for controlling the flying of a collapsible kite and for compactly storing the kite along with the kite line after use. The apparatus includes a housing having a storage compartment wherein the kite is stored. A reel adapted for dispensing and storing the kite line is attached to the housing. A mechanism is included for operating the reel such that kite line is removable from the reel during the flying of the kite and is windable back on the reel in a smooth manner.

BRIEF DESCRIPTION OF THE DRAWINGS

FIG. 1 is a perspective view of the kite apparatus for controlling and storing a kite;

FIG. 2 is a top plan view of the control and storage mechanism of the present invention;

FIG. 3 is a cross sectional view of the interior of the storage and control mechanism taken along the line 3—3 in FIG. 2;

FIG. 4 is a fragmentary cross sectional view of the top rear portion of the control and storage mechanism taken along the line 4—4 in FIG. 3;

FIG. 6 is an exploded fragmentary perspective view of a handle used to operate a reel in the control and storage mechanism;

FIG. 7 is a fragmentary perspective view of an alternative embodiment of a handle used to operate a reel;

FIG. 9 is an exploded perspective view of a preferred embodiment of a kite used with the control and storage mechanism of the present invention;

FIG. 10 is a perspective view of a union that holds the kite frame together;

FIG. 11 is a cross sectional view of a frame member of the kite frame taken along line 11—11 in FIG. 9;

FIG. 12 is a perspective view of an inflatable kite;

FIG. 13 is a perspective view of an inflatable kite of FIG. 12 taken at a different angle;

FIG. 14 is a perspective view of a frame member having a bendable section, the view being taken within the broken circle 14 in FIG. 9;

FIG. 15 is a perspective view of the frame member shown in FIG. 14 in a bent position;

DETAILED DESCRIPTION OF THE PREFERRED EMBODIMENTS

Figure 16:
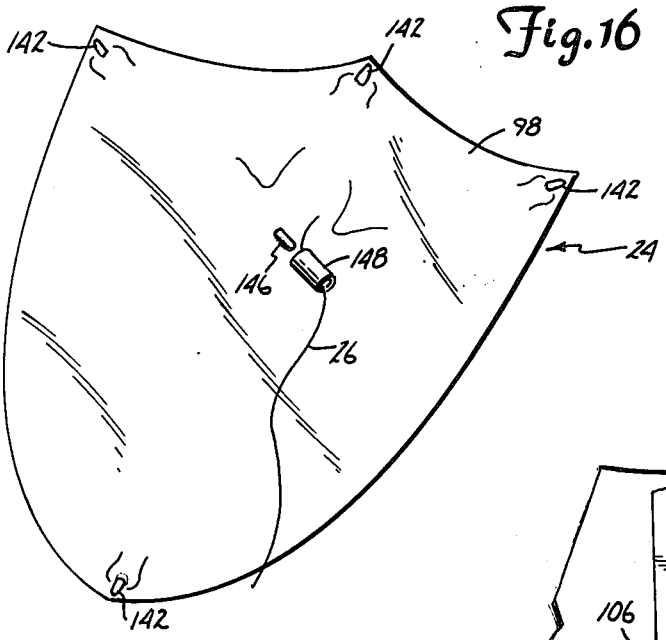
FIG. 16 is a perspective view of a preferred manner of attaching the kite line to the kite using a connective sleeve.

The apparatus for controlling and storing a kite of the present invention is generally indicated at 20 in FIG. 1. Throughout the figures like reference characters will be used to indicate like elements. The apparatus 20 includes a control and storage mechanism, generally indicated at 22, and a collapsible kite 24. A kite line 26 connects the mechanism 22 with the kite 24 and is used for flying and controlling the kite.

The control and storage mechanism 22 is further illustrated in FIGS. 2–6. The mechanism 22 includes a housing 28 that is preferably elongated in shape and of a small size that is easily held within a hand 29, as illustrated in FIG. 1. The housing 28 is made of left and right housing halves 30, 32, respectively, as shown in FIG. 2. The left and right housing halves 30, 32 are preferably made of plastic and are attached to each other by suitable cooperating snaps that are an integral part of the left and right housing halves 30, 32. Each housing half has a lower contoured edge 33, as illustrated in FIG. 3, contoured in the shape of a "grip" to facilitate holding the housing in a hand 29, as illustrated in FIG. 1.

As illustrated in FIG. 3, a door 34 defines part of the rearward portion of the housing 22. The door 34 opens in a direction of arrow 36 to expose a compartment 38 that is defined by interior surfaces of the housing 22. The compartment 38 is used to store the various components of the kite 24. As illustrated in FIG. 4, the door 34 pivots about a pair of projections 40, 42 which extend outwardly into cooperating indentations 44, 46 in right and left housing halves 32, 30, respectively.

The door 34 is also usable as a weight for helping to fly the kite in certain conditions. The door 34 has an opening 48 in a lower portion thereof, illustrated in FIG. 3. To use the door as a weight, such as in the tail end of the kite 24, the door is simply removed from the housing 22 by a twisting action that disengages either the projection 40 or the projection 42 from the respective cooperating indentation 44 or 46. After the door 34 is removed, the door is attached to the tail end of the kite by inserting a string or the like through opening 48 and then tying the door to the kite proximate the tail end.

Figure 5:
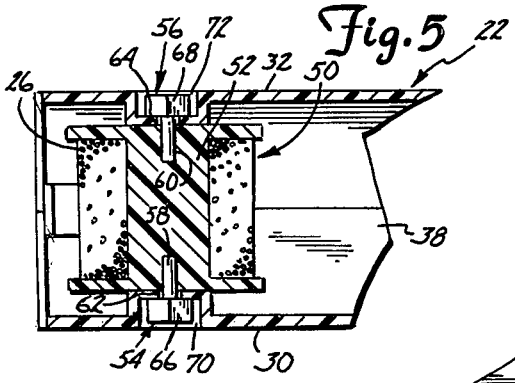
FIG. 5 is a fragmentary cross sectional view of a forward portion of the storage and control mechanism taken along the line 5—5 in FIG. 3.

As shown in FIGS. 2 and 5, a reel 50 is preferably positioned within the housing 28 at a forward end thereof. The reel 50 includes a kite line spool 52 having kite line 26 wound thereon and rotatably attached within the housing 22 by pins 54 and 56. The pins 54 and 56 have shaft portions 58, 60 that project through suitable openings 62, 64 in respective housing halves 30, 32. The shaft portions 58, 60 extend into and frictionally engage the spool 52. The openings 62 and 64 in the housing halves are of a greater diameter than the diameter of the shaft portions 58 and 60, allowing the pins 54, 56 and the spool 52 to rotate with respect to the housing 28. The openings are recessed within the housing 28.

The pins 54, 56 preferably have heads 66, 68, respectively, each head having a substantially square configuration and positioned within recesses 70, 72 in respective housing halves 30, 32. As illustrated in FIG. 6, a crank handle 74 is attachable to the head 66 of the pin 54 proximate housing half 30. Similarly, the handle 74 may be attachable to the head 68 of the pin 56 proximate housing half 32. The handle 74 includes a crank arm member 76 with a head engaging recess 78 similar in size and configuration to head 66 for frictionally engaging the head 66. A knob, generally indicated at 80, is attached to the arm 76 on an end opposite from the recess 78. The knob 80 includes a crank spool 82 attached to the arm 74 by a pin 84 whose shank portion 85 extends through the spool 82. The pin 84 is attached to the arm 76 at a distal end by prongs 86 extending into an aperture 88 located in the distal end of the shank portion 85. It will be appreciated that when the knob 80 is grasped to turn the arm 76, the spool 82 will rotate freely about the shank portion of the pin 84, facilitating the turning of the crank handle 74 and the kite line spool 52. The crank handle 74 when detached from the pin 54 is stored within the compartment 38.

In an alternative embodiment of the control and storage mechanism generally illustrated at **22*a* in FIG. 7, a crank spool 89 is slidable through an opening 91 in an arm member 93 in a direction substantially perpendicular to the plane of the arm member 91. A crank spool receiving aperture 95 for receiving an end of the crank spool 89 is positioned within the control and storage mechanism. Positioning the end of the crank spool 89 within the spool receiving aperture 95 provides a stop that prevents reel 50*a* from winding or unwinding the kite line. Normally, the spool 89 is in the innermost position in which the crank and the outer end of the spool 89 are closely adjacent the housing 22*a*. The spool 89 is pulled out whenever it is desired to wind or unwind the line, the spool being used as a handle. The inner end of the spool 89 is provided with a flange 97 which prevents the removal of the handle as in the other modification. The inner end of spool 89 is split as shown at 99 to allow the two portions to be sprung together to permit the insertion of flange 97 into the opening 95**.

As shown in FIGS. 2 and 3, the housing 22 has an opening 90 through which the kite line 26 is let out from the reel 50 to fly the kite and is reeled in to retrieve the kite. The opening 90 preferably extends across the width of the spool 52.

Figure 8:
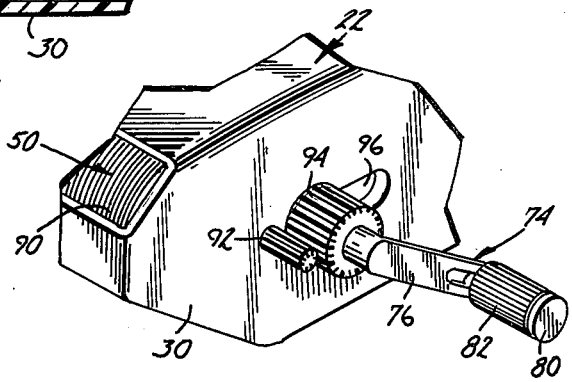
FIG. 8 is a fragmentary perspective view of an alternative embodiment of the control and storage mechanism including gears which facilitate quick rewinding of the kite line.

In an alternative embodiment, illustrated in FIG. 8, a pair of gears is included for facilitating quicker retrieval of line 26 and the kite 24. A first gear 92 is fixedly attached to the reel 50 in a suitable manner such that the gear 92 drives the reel 50. A second gear 94, larger in diameter than the first gear 92, is fixedly attached to the handle 74 which is rotatably attached to the housing 22 within a slot 96 by any suitable means which holds it against withdrawal from the housing. As is easily understood by those skilled in the art, one turn of the handle 74 will cause multiple turns of the gear 92 and facilitate quicker retrieval of the line 26 and the kite 24. To dispense line out, the gear 94 is disengaged from the gear 92 by sliding the handle 24 along the slot 96. The reel is then completely disengaged from the handle 74 and can rotate freely.

The kite 24, as illustrated in FIG. 1, includes a flexible kite sail material 98 for receiving the force of the wind and providing a motive force to the kite. The kite material 98 is stretched over a sufficiently rigid kite frame 100 and is preferably made of a suitable kite material. The kite frame 100 is sufficiently rigid to hold the kite material 98 in a stretched-out manner but is also sufficiently yieldable to allow easy attachment of the kite material 98 to the frame 100. Preferably, the kite of the present invention is relatively small in size, ¼ the size of an average size kite. Preferably, the kite is approximately 8 to 9 inches in length and 10 to 12 inches wide.

The elements of the kite frame are more fully illustrated in FIG. 9 wherein an embodiment **100*a* is shown. The kite frame 100*a* includes a forward frame member 102 in coaxial alignment with a keel frame member 104, both frame members 102 and 104 being connected in coaxial alignment with each other by a union 106. The union 106 also rigidly connects a left wing frame member 108 and a right wing frame member 110 to each other and in a substantially transverse relationship to the frame members 102 and 104. The union 106, as more fully illustrated in FIG. 10, has a main hollow body portion 112 which frictionally holds the frame members 102 and 104. A pair of integral left and right legs 114 and 116 are transversely positioned to the body portion 112 and are inclined with respect to each other. The left and right legs 114 and 116 have apertures for frictionally engaging the left and right frame members 108 and 110, respectively. The kite frame 100 in FIG. 1 is similarly constructed as kite frame 100*a***.

Each of the frame members 102, 104, 108 and 110, as shown in FIG. 9, is formed of a central shaft member 118 with four outwardly extending ribs 120 spaced substantially equal distances from each other and integral with the shaft member 118, as illustrated in FIG. 11. The ribs 120 provide a beam strength to the frame members along their longitudinal axis and frictionally engage the union 106 with their outer surfaces.

The kite frames 100 and 100*a* are collapsible kite frames so that the frames and the sail material can be compactly stored within the compartment 38. As illustrated in FIG. 1, the kite frame 100 includes a forward frame member 122, a keel frame member 124, left wing frame member 126, and right wing frame member 128, each frame member being made of a suitable tubular plastic material and frictionally engaging a suitable central union 129. When the user is through flying the kite 24, the kite sail material 98 is detached from the frame 100 and each of the frame members 122, 124, 126 and 128 are detached from the central union 129 and placed within the housing 22.

In the embodiment 100*a*, illustrated in FIG. 9, the frame members 102, 104, 108 and 110 do not have to be detached from the union 106. The keel frame member 104, the left wing frame member 108 and the right wing frame member 110, each have a bendable portion 130 as best shown in FIGS. 14 and 15. Proximate the bendable portion 130, the ribs 120 taper to a common point of convergence on the shaft member 118, with the shaft member 118 acting as a hinge at the common point of convergence for each of the frame members 104, 108 and 110. The frame members 104, 108 and 110 are preferably made of a material, such as polypropylene, which has a hinging characteristic allowing the shaft member to bend.

To cause the bendable portion to be rigid, for purposes of assembling the kite frame, a sleeve 132 circumferentially engages the frame members and is slidable in the direction of arrow 134. The sleeve 132 provides sufficient rigidity to the bendable portion 130 when slid thereover. To store the kite, the sleeve 132 is slid in the direction of arrow 136, as illustrated in FIG. 15, and the frame member 104 is bent in the direction of arrow 138. As a result, the kite frame 100*a* is collapsed without detaching the frame members from the union and thereby further insuring that the various components of the frame 100*a* are not lost during storage.

As illustrated in FIG. 9, the bendable portion 130 is positioned along each of the appropriate frame members such that when the frame members are bent in the general direction of arrows 140, the bent frame members have their distal ends positioned proximate the distal end of the frame member 102 which is not bent. Although the frame 100*a* has been immediately described with particular detail as to bendable portion 130, it will be understood by those skilled in the art that the appropriate frame members may be bendable by other means, not disclosed herein, and made rigid in another manner other than the sleeve 132 and still be within the spirit and scope of the present invention. For example, the keel frame member and the left and right wing frame members may be made of a bendable plastic tubing.

To assemble the kite 24, each of the frame members of the kite frames 100 and 100*a* preferably have a projection 142 disposed at their distal ends. The kite sail material 98 is fastened to the kite frames 100 and 100*a* by extending the projections 142 in properly positioned apertures 144 in the kite sail material 98.

Figure 17:
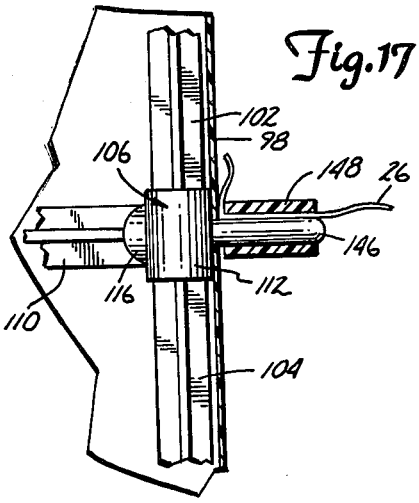
FIG. 17 is a fragmentary cross sectional view of the kite string attached to the union through the use of the connective sleeve.

The kite line 26 and the kite 24 are attached to each other by placing a stud 146 of the union 106 through an aperture 147 in the kite sail material 98. The stud 146 projects through the kite sail material 98, as illustrated in FIGS. 16 and 17, and frictionally engages a kite string connector sleeve 148. The kite line 26 is positioned within the connector sleeve 148 and is squeezed between any interior surface of the connector sleeve 148 and the stud 146 securely connecting the kite line 26 to the kite 24.

To fly the kite 24, the line 26 may either be pulled out from the reel 50 by hand or the handle 74 may be turned in a direction that will unwind the line 26 from the reel 50. The kite is easily controlled by holding the housing 22 in one hand, as illustrated in FIG. 1.

To retrieve the kite 24, the handle 74 is simply turned in a direction that will wind the line 26 onto the reel 50. After the kite 24 has been retrieved, the connector sleeve 148 is disengaged from the prong of the union 106 to disengage the kite line 26 from the kite 24.

To store the kite 24 for future use, the kite sail material 98 is removed from the kite frame 100 and folded and placed within the storage compartment 38 of the housing 22, as illustrated in FIG. 3. The kite frame is also collapsed by either disassembling or bending the appropriate frame members, depending on which embodiment of a kite frame is used. The frame 100 along with central union 129 is also placed within the housing 22 for future use. In addition, the handle 74 can be detached from the head 66 of the pin 54 and stored within the compartment 38.

Alternatively, an inflatable kite, generally indicated at 131 in FIGS. 12 and 13, is used with the apparatus of the present invention. The kite 131 has four longitudinal pouches 133*a–d*, each pouch substantially separated from the other pouches by a seam 129. The kite is made of a flexible thermoplastic material and each seam 129 is formed by a suitable heat sealing process. The four pouches 133*a–d* are inflatably connected at a forward end 135 of the kite 131, and each pouch has a closed rear end and tapers to the forward end forming a V-shaped kite. A suitable valve 137 allows the user to inflate the kite 131 with air or another suitable gas and stops the air from escaping from the kite once the kite is inflated. A center flap 139 is fixedly attached to an underside of the seam 129 that separates pouches 133*b* and 133*c* and extends generally downwardly therefrom. A kite string grommet 141 with an aperture is located on a lower end of center flap 139. The grommet 141 is used to attach the kite string 26 to the kite 131 by passing the string 26 through the grommet and tying the string with a suitable knot. A kite tail grommet 143 with an aperture is located at a rearward end of the kite 131 for attaching a kite tail 145 to the kite 131.

Although the inflatable kite 131 has been described with particular detail, all suitable configurations of inflatable kites are included within the present invention. Some examples of inflatable kites are disclosed in the following patents and are herein incorporated by reference: Sparkman U.S. Pat. No. 2,769,605; Pohl U.S. Pat. No. 3,003,722; Neal U.S. Pat. No. 3,335,985; Laske U.S. Pat. No. 3,952,975; and Laske U.S. Pat. No. 3,980,260. Another suitable inflatable kite is manufactured by Gayla Industries, Inc. of Houston, Tex. An important element of the inflatable kite is that the kite is deflatable to a size capable of storage within the housing 22.

The kite apparatus, as disclosed herein, has several advantages:

1. The various components of the kite can be stored in the compartment of the housing and not be either lost or damaged.

2. The housing and compartment offer a ready storage space for the kite, eliminating the inconvenience of trying to find a proper place to store the kite without loosing the components or having the kite damaged during storage.

3. The kite can be flown by simply holding the housing 22 in one hand, in contrast to trying to balance a ball of kite line in one hand while dispensing line with the other.

4. The kite line is stored on the reel in a neat and organized manner unlike rewinding kite line in a ball.

5. The kite line, being stored on a reel attached to the same housing that stores the disassembled kite, will not become separated from the kite during storage minimizing the chances of the line becoming lost or used for purposes other than flying the kite. Consequently, a new line will not have to be purchased to fly the kite the next time.

Although the present invention has been described with reference to preferred embodiments, workers skilled in the art will recognize that changes may be made in form and detail without departing from the spirit and scope of the present invention.

What is claimed is:

1. A kite apparatus comprising:

a collapsible kite;

a kite line having a first end and a second end, the first end being attached to the collapsible kite; and a housing having an interior compartment for storing the kite in a collapsed state and reel means for storing the kite line with the second end of the kite line being attached to said reel means for storing, the housing further including a door adapted to reveal the interior compartment and allow the kite to be stored within the compartment in a collapsed state and the door being securable to a closed position and wherein the door has means for permitting complete detachment from the housing and has connective means for facilitating connection to the kite for use as a weight in the control and flying of the kite.

2. An apparatus for both controlling and storing a collapsible kite, the kite being controlled by a kite control line attached to the apparatus at one end and to the kite at the other, the apparatus comprising:

a housing having a storage compartment wherein the kite is stored in a collapsed state, the housing including a door adapted to reveal the storage compartment, allowing the kite to be stored within the compartment in a collapsed state, and the door being securable in a closed position, and including pivot means for permitting the door to pivot from a closed position to an open position and for permitting complete detachment of the door from the housing, and connective means for facilitating connection of the door to an appropriate place on the kite for use as a weight in the control and flying of the kite;

reel means adapted for dispensing and storing the kite control line; and means for operating the reel means such that the kite control line is removable and windable on said reel means.

3. The apparatus of claim 2 wherein the reel means is attached to an interior surface of the housing and is rotatable within the housing.

4. A foldable kite frame for use in a kite apparatus having a flexible kite sail material, the frame comprising:

a plurality of kite frame members, each of the frame members including a longitudinal solid shaft portion and a plurality of outwardly extending ribs integral with the shaft portion and each of the kite frame members, except one frame member, having a bendable section and each of the frame members having a distal end and each of the bendable sections being positioned such that the frame members with bendable sections can be bent to lie along axes that are parallel to the axis of the frame member with no bendable section, and the adjacent ends of the ribs of each bendable section tapering to a common point on the solid shaft portion to facilitate bending of the section;

means for providing rigid longitudinal support to the bendable section of each frame member, said means for providing being removable from providing rigid longitudinal support when desired; and connective means for rigidly connecting each of the frame members to each other.

5. The frame of claim 4 wherein the means for providing rigid support includes a sleeve circumferentially surrounding each frame member with a bendable section and coaxially slidable along the frame members over the bendable sections to supply rigid longitudinal support thereto.

6. The frame of claim 4 wherein the connective means is a central union having means for frictionally engaging each of the frame members.

7. A kite apparatus comprising:

a collapsible kite wherein the kite includes a flexible sail material and a collapsible frame, the collapsible frame including a plurality of frame members and a union having means for rigidly and detachably connecting the frame members to each other, and each frame member, except one frame member, having a bendable section with each of the frame members with the bendable section being bendable along the longitudinal axis of the frame member without a bendable section, and further including a sleeve circumferentially surrounding each frame member with a bendable section and coaxially slidable along the frame members over the bendable sections to supply rigid support thereto and each of the frame members comprising a longitudinal shaft portion and a plurality of outwardly extending ribs integral with the shaft portion and the bendable section being formed by having the ribs taper to a common point on the shaft portion;

a kite line having a first end and a second end, the first end being attached to the collapsible kite; and a housing having an interior compartment for storing the kite in a collapsed state and reel means for storing the kite line with the second end of the kite line being attached to said reel means for storing and a crank handle attached to the reel means for rotation thereof and including a crank arm disposed outside of the housing and extending radially from an axis of the reel means and having a first aperture at a distal end and a handle spool rotatably and slidably disposed within the first aperture, and said housing including a second aperture for receiving the handle spool, the handle spool being slidably positionable for engaging both the crank arm and housing securing the reel means in a fixed position.

8. The apparatus of claim 7 wherein the means for storing the kite line is a reel rotatably attached to interior surfaces of the housing and the housing having an opening for the kite line to extend from the reel to the kite.

9. The apparatus of claim 7 wherein the housing further includes a door adapted to reveal the interior compartment and allow the kite to be stored within the compartment in a collapsed state and the door being securable to a closed position.

10. The apparatus of claim 9 wherein the door has means for permitting complete detachment from the housing and has connective means for facilitating connection to the kite for use as a weight in the control and flying of the kite.

11. The apparatus of claim 7 wherein the kite is an inflatable kite.

12. The apparatus of claim 11 wherein the inflatable kite includes:

a plurality of inflatable gas retaining longitudinal pouches constructed from a common flexible sheet, each pouch having a rearward gas sealed end and a common gas chamber at a forward end, all of the pouches being inflatably connected at the common gas chamber; and valve means for inflating all of the pouches with a gas through the common gas chamber and for stopping escape of the gas after inflation and for permitting deflation of the kite to a collapsed state for storage within the interior compartment of the housing.

13. The apparatus of claim 12 wherein the inflatable kite further includes a flap member centrally located among the pouches to a bottomside of the pouches, the flap member being attached to the first end of the kite line.

14. The apparatus of claim 12 wherein each pouch tapers from the rearward end to the forward end forming a V-shaped kite.

15. A collapsible kite comprising:

a plurality of kite frame members, each of the frame members including a longitudinal solid shaft portion and a plurality of outwardly extending ribs integral with the shaft portion and each of the kite frame members, except one frame member, having a bendable section and the adjacent ends of the ribs of each bendable section tapering to a common point on the solid shaft portion to facilitate bending and all of the frame members having distal ends;

means for providing rigid longitudinal support to the bendable section of each frame member, said means for providing being removable from providing rigid longitudinal support when desired;

connective means for rigidly connecting each of the frame members to each other; and a flexible kite sail material positioned over the kite frame and attached to the distal ends of the frame members.

16. The kite of claim 15 wherein each of the bendable sections is positioned such that when the frame members with bendable sections are bent to lie along axes that are parallel to the axis of the frame member with no bendable section, with the distal ends of the frame members being proximate to each other.

17. The kite of claim 15 wherein the connective means is a central union having means for frictionally engaging each of the frame members.

* * * * *